US007806552B1

(12) United States Patent
St. Julien

(10) Patent No.: US 7,806,552 B1
(45) Date of Patent: Oct. 5, 2010

(54) LIGHTED COOLER

(76) Inventor: Terry L. St. Julien, 639 Point Buchon Ct., Chula Vista, CA (US) 91911

( * ) Notice: Subject to any disclaimer, the term of this patent is extended or adjusted under 35 U.S.C. 154(b) by 136 days.

(21) Appl. No.: 12/331,420

(22) Filed: Dec. 9, 2008

(51) Int. Cl.
*F21V 33/00* (2006.01)

(52) U.S. Cl. ..... 362/154; 362/92; 362/234; 446/11

(58) Field of Classification Search ..... 362/154, 362/92, 101, 126; 206/96, 142; 40/637; 62/264
See application file for complete search history.

(56) References Cited

U.S. PATENT DOCUMENTS 4,754,376 A * 6/1988 Winslow ..... 362/92
5,032,957 A * 7/1991 Canfield ..... 362/133
5,676,459 A * 10/1997 Bedford et al. ..... 362/390
6,438,983 B1 * 8/2002 Zellner et al. ..... 62/246
6,749,319 B1 * 6/2004 Muse ..... 362/154
7,080,920 B2 * 7/2006 Fitzsimmons et al. ..... 362/155

* cited by examiner

*Primary Examiner*—Ali Alavi

(57) ABSTRACT

A lighted cooler includes a thermally-insulated cooler body having a cooler body interior, at least one lid carried by the cooler body and closeable over the cooler body interior, a front body panel carried by the cooler body, a transparent light panel carried by the cooler body in spaced-apart relationship with respect to the front body panel, a plurality of lights carried by the front body panel adjacent to the transparent light panel, a power source electrically connected to the plurality of lights and a light control button electrically connected between the power source and the plurality of lights.

12 Claims, 8 Drawing Sheets

LIGHTED COOLER

FIELD OF THE INVENTION

The present disclosure relates to coolers. More particularly, the present disclosure relates to a lighted cooler which is portable.

BACKGROUND OF THE INVENTION

Coolers are commonly used to transport food and/or beverages in a cooled condition. A typical conventional cooler includes an insulated bottom and walls with an insulated lid which is removably fitted on the walls. However, conventional coolers are typically not lighted.

Therefore, a lighted cooler having an eye-catching and stylish design is needed.

SUMMARY

The present disclosure is generally directed to a lighted cooler comprising a thermally-insulated cooler body having a cooler body interior, at least one lid carried by the cooler body and closeable over the cooler body interior, a front body panel carried by the cooler body, a transparent light panel carried by the cooler body in spaced-apart relationship with respect to the front body panel, a plurality of lights carried by the front body panel adjacent to the transparent light panel, a power source electrically connected to the plurality of lights and a light control button electrically connected between the power source and the plurality of lights.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the invention and are not intended to limit the scope of the invention which is defined by the claims. Furthermore, there is no intention to be bound by any expressed or implied theory presented in the preceding technical field, background, brief summary or the following detailed description.

Figure 1:
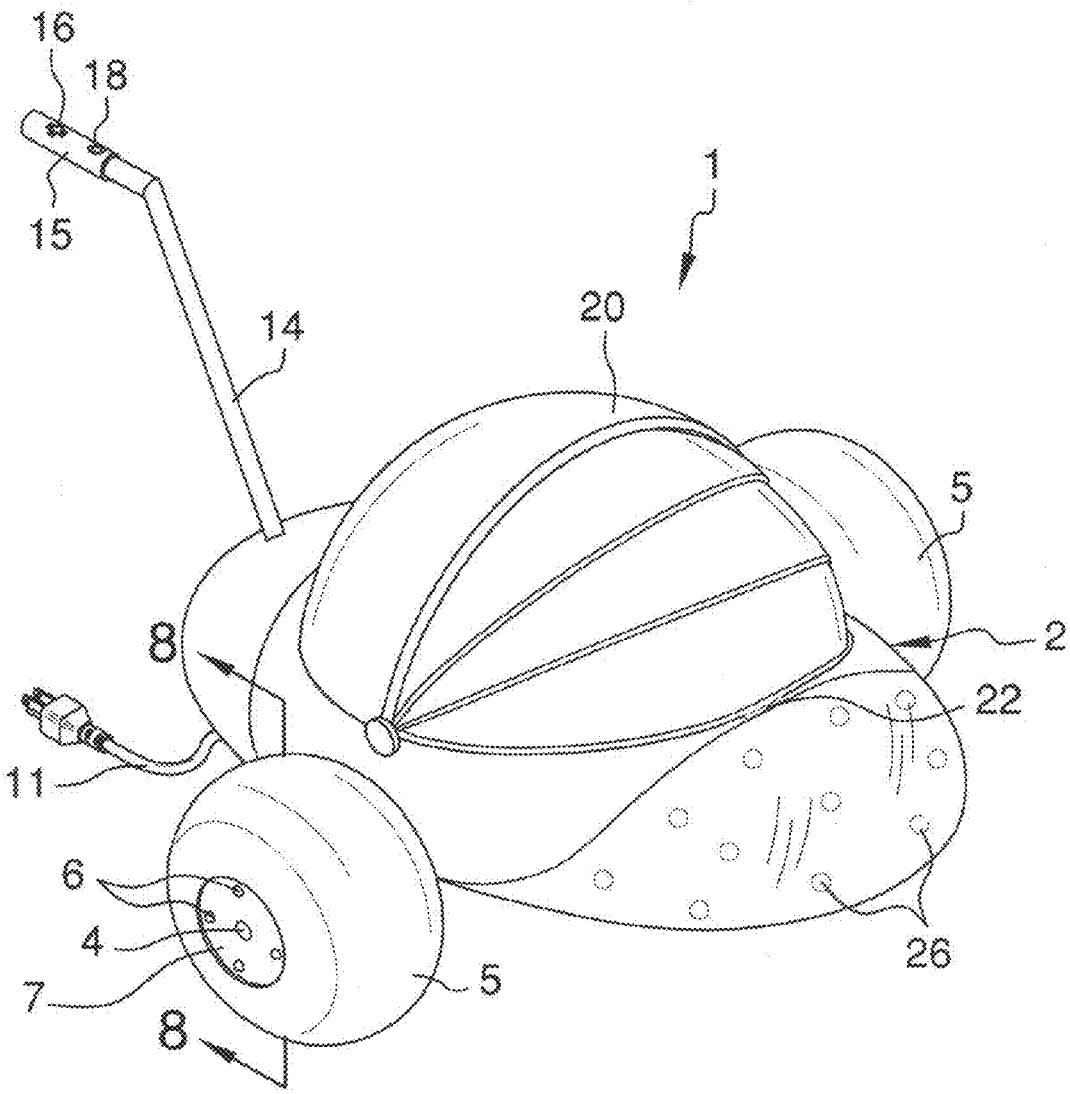
FIG. 1 is a front perspective view of an illustrative embodiment of the lighted cooler.
Figure 2:
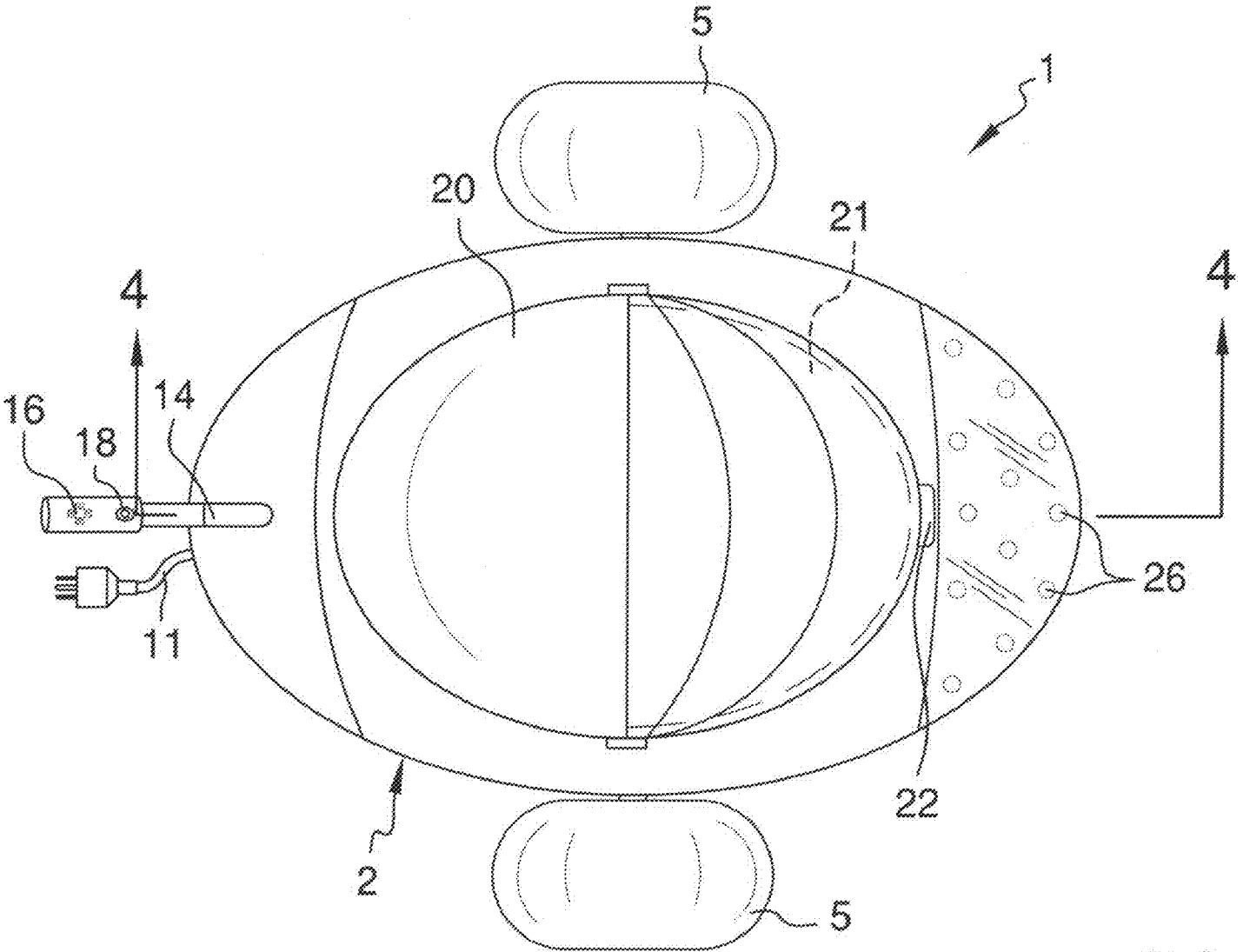
FIG. 2 is a top view of an illustrative embodiment of the lighted cooler.
Figure 3:
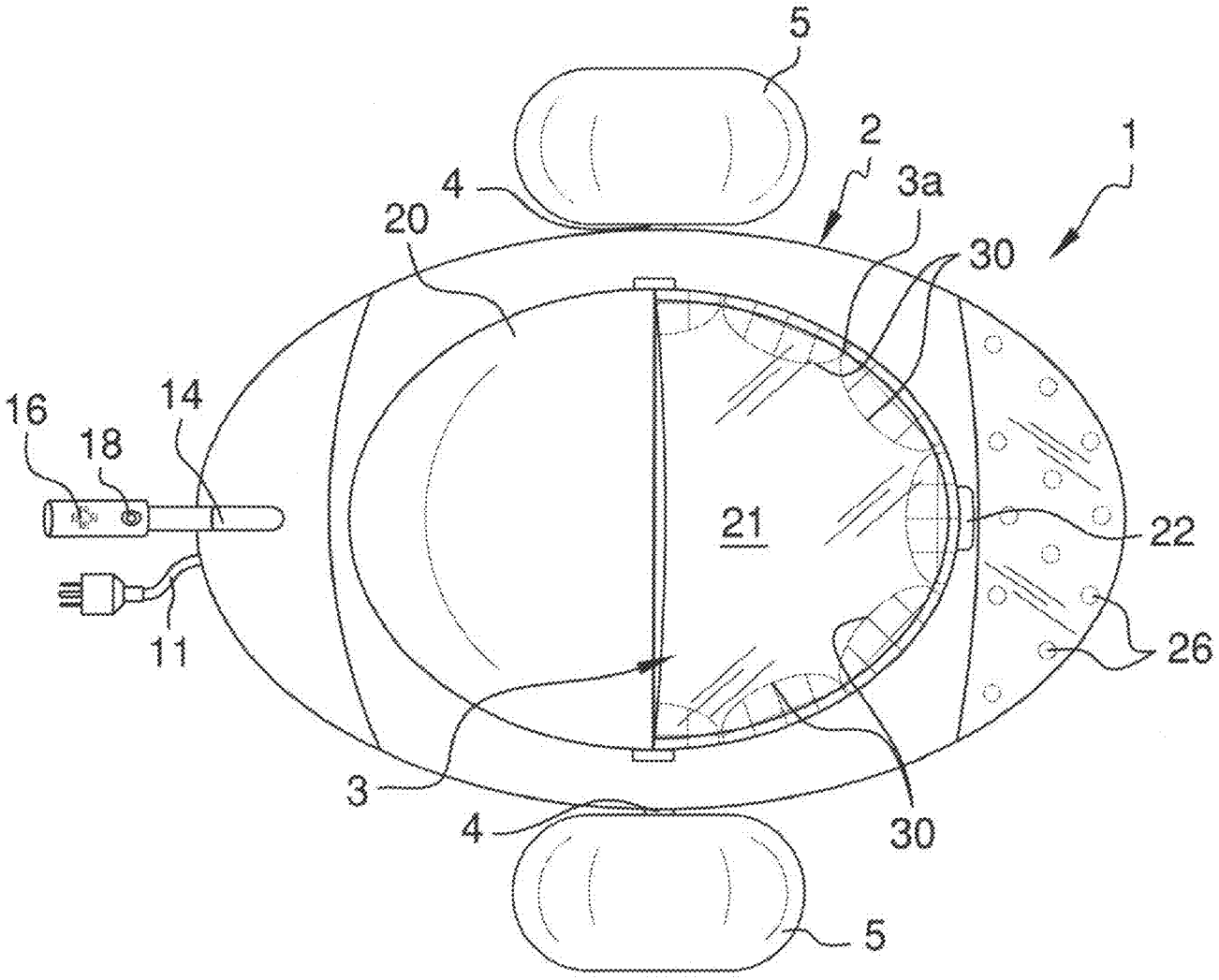
FIG. 3 is a top view of an illustrative embodiment of the lighted cooler, with the outer lid disposed in an open position.
Figure 4:
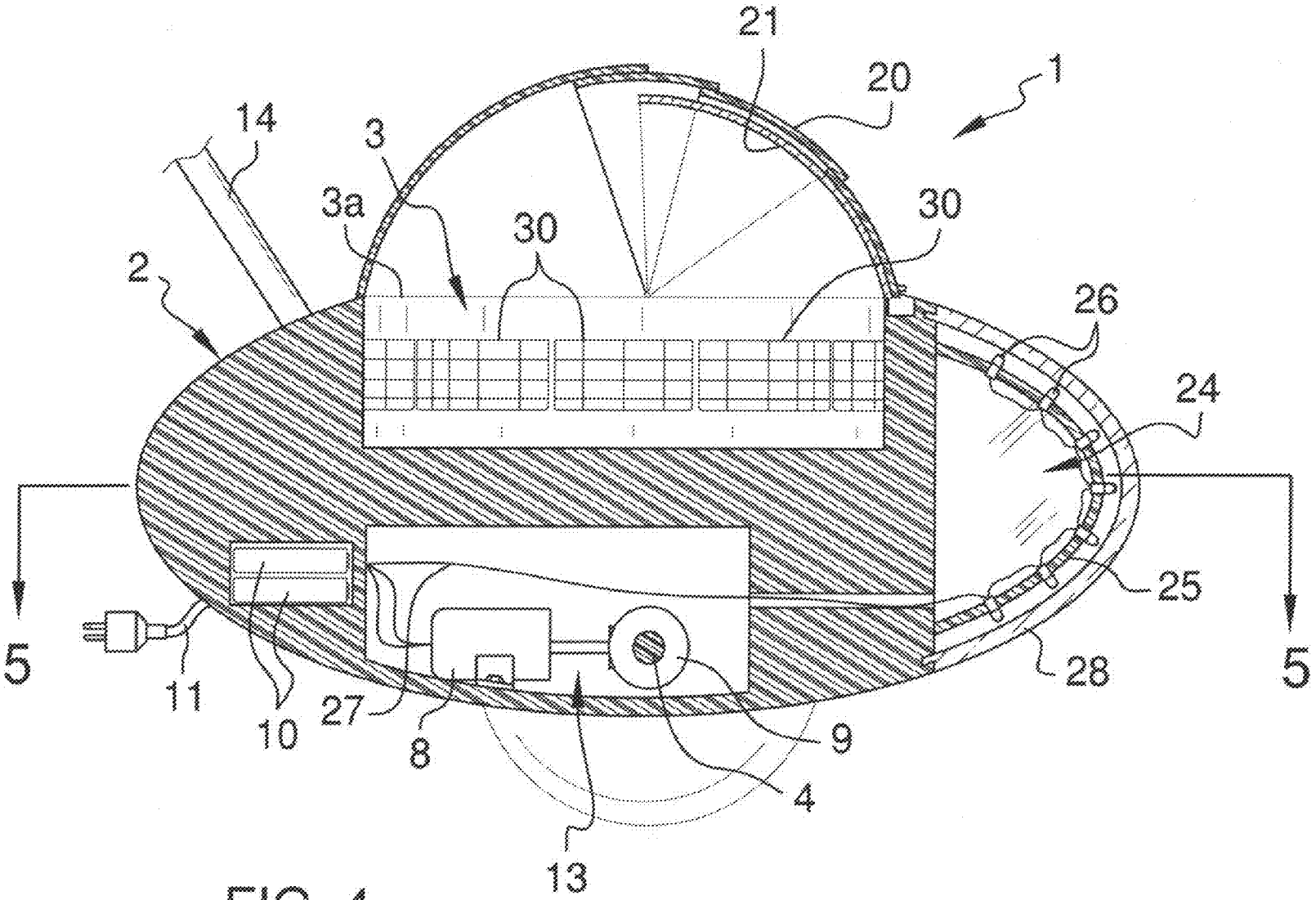
FIG. 4 is a sectional view, taken along section lines 4-4 in FIG. 2.
Figure 5:
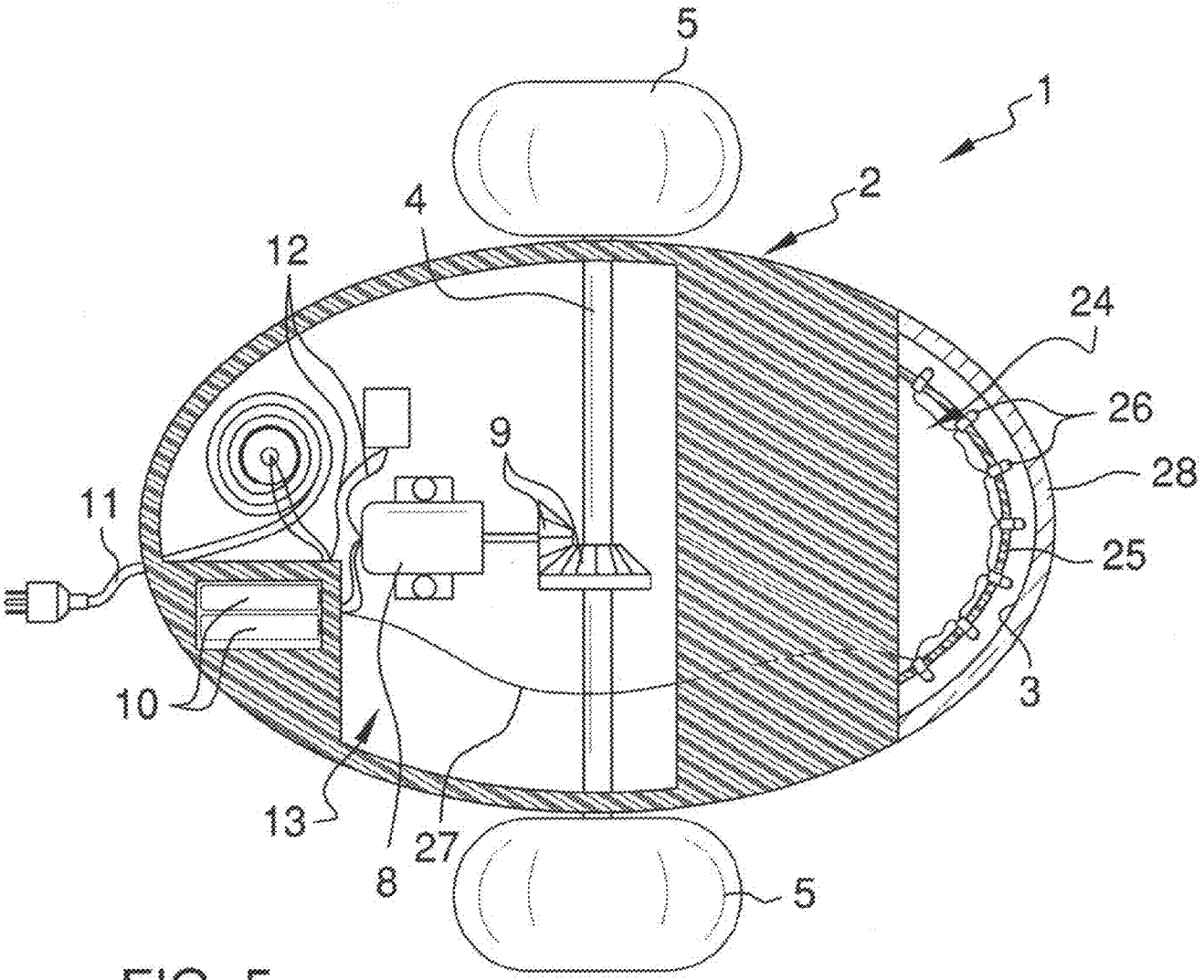
FIG. 5 is a sectional view, taken along section lines 5-5 in FIG. 4.
Figure 6:
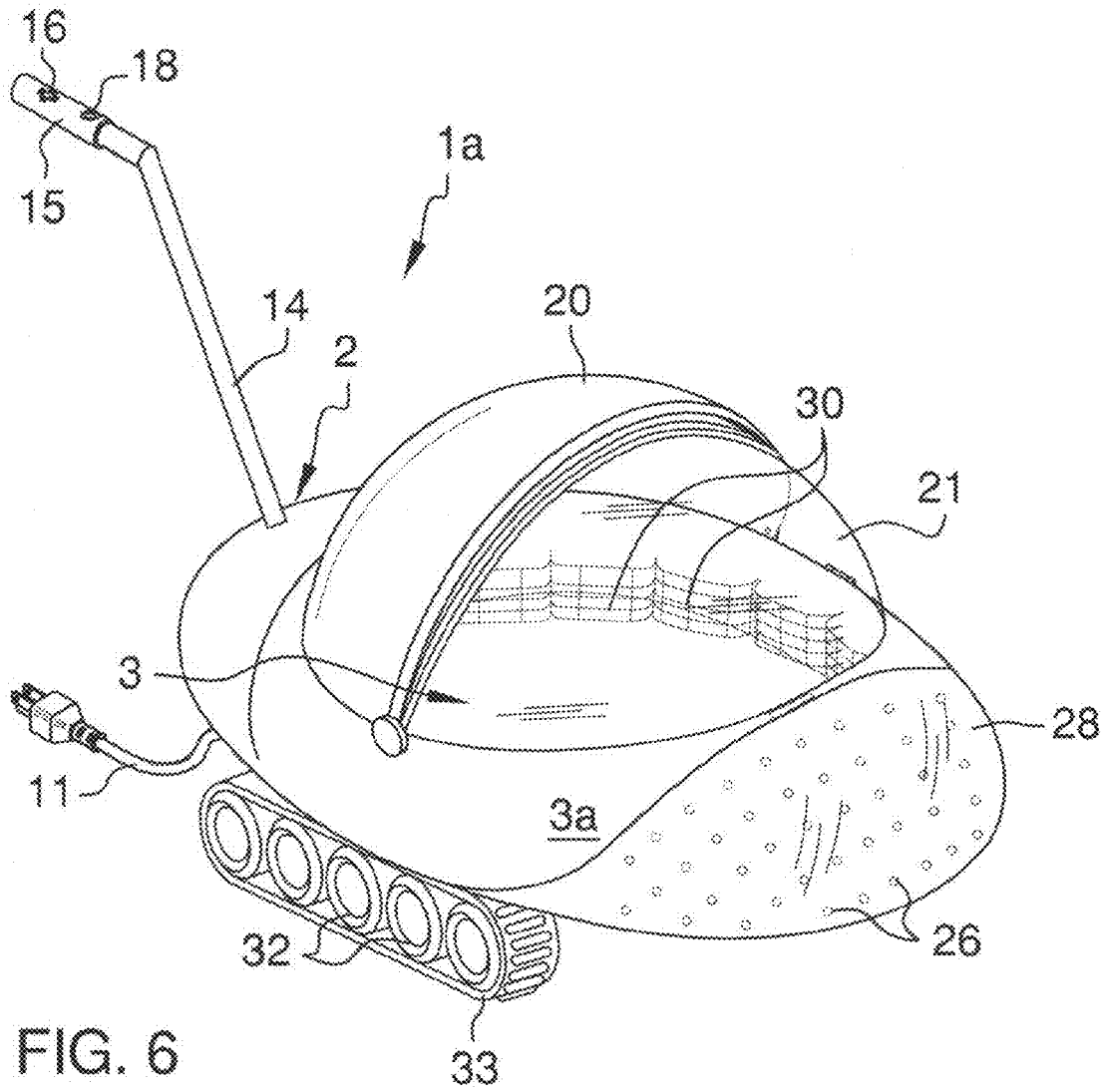
FIG. 6 is a front perspective view of an alternative illustrative embodiment of the lighted cooler.

Referring initially to FIGS. 1-6 and 8 of the drawings, an illustrative embodiment of the lighted cooler is generally indicated by reference numeral 1. The lighted cooler 1 includes a thermally insulated cooler body 2 which may have a generally elongated, elliptical, oval or egg-shaped configuration. As shown in FIG. 4, a cooler interior 3 having an opening 3*a*, which may have a generally elliptical shape, is provided in the cooler body 2. As shown in FIGS. 3, 4 and 6, in some embodiments multiple nets 30 may be provided in the cooler interior 3 along the wall thereof to receive and secure foods and/or beverages in the cooler interior 3. An elongated handle shaft 14 may extend from the cooler body 2. A handle grip 15 may be provided on the handle shaft 14.

Figure 1A:
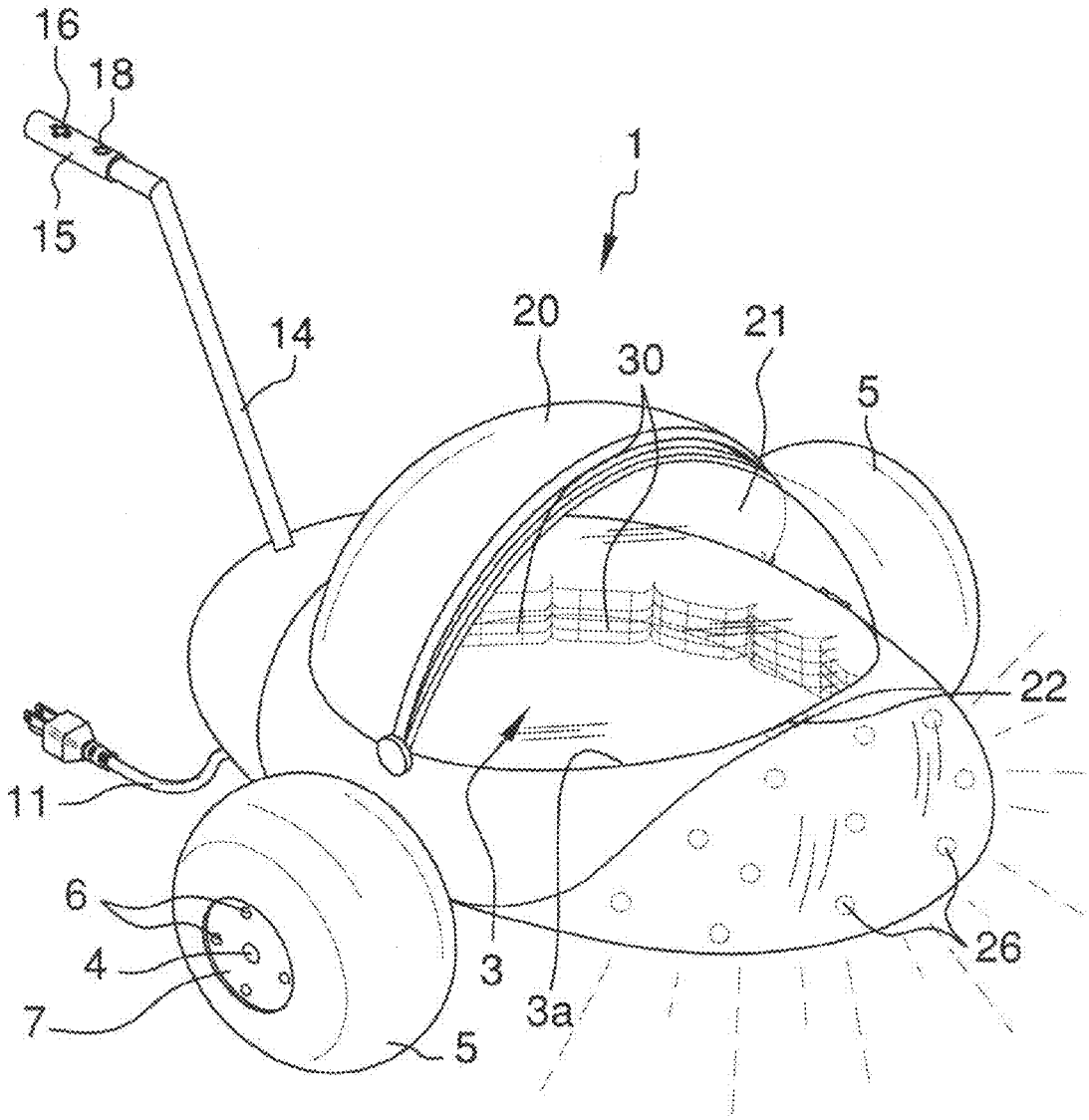
FIG. 1A is a front perspective view of an illustrative embodiment of the lighted cooler, with an outer lid disposed in an open position.

A thermally-insulated retractable outer lid 20 is provided on the cooler body 2. The retractable outer lid 20 can be selectively opened and closed over the opening 3*a* of the cooler interior 3. As illustrated in FIGS. 1A, 3 and 4, in some embodiments, a transparent retractable inner lid 21 is additionally provided on the cooler body 2 beneath the retractable outer lid 20 and can be selectively opened and closed over the opening 3*a* independently of the retractable outer lid 20. A finger space 22 may be provided in the cooler body 2 at the edge of the closed retractable outer lid 20 and/or retractable inner lid 21 for aid in opening each.

Figure 8:
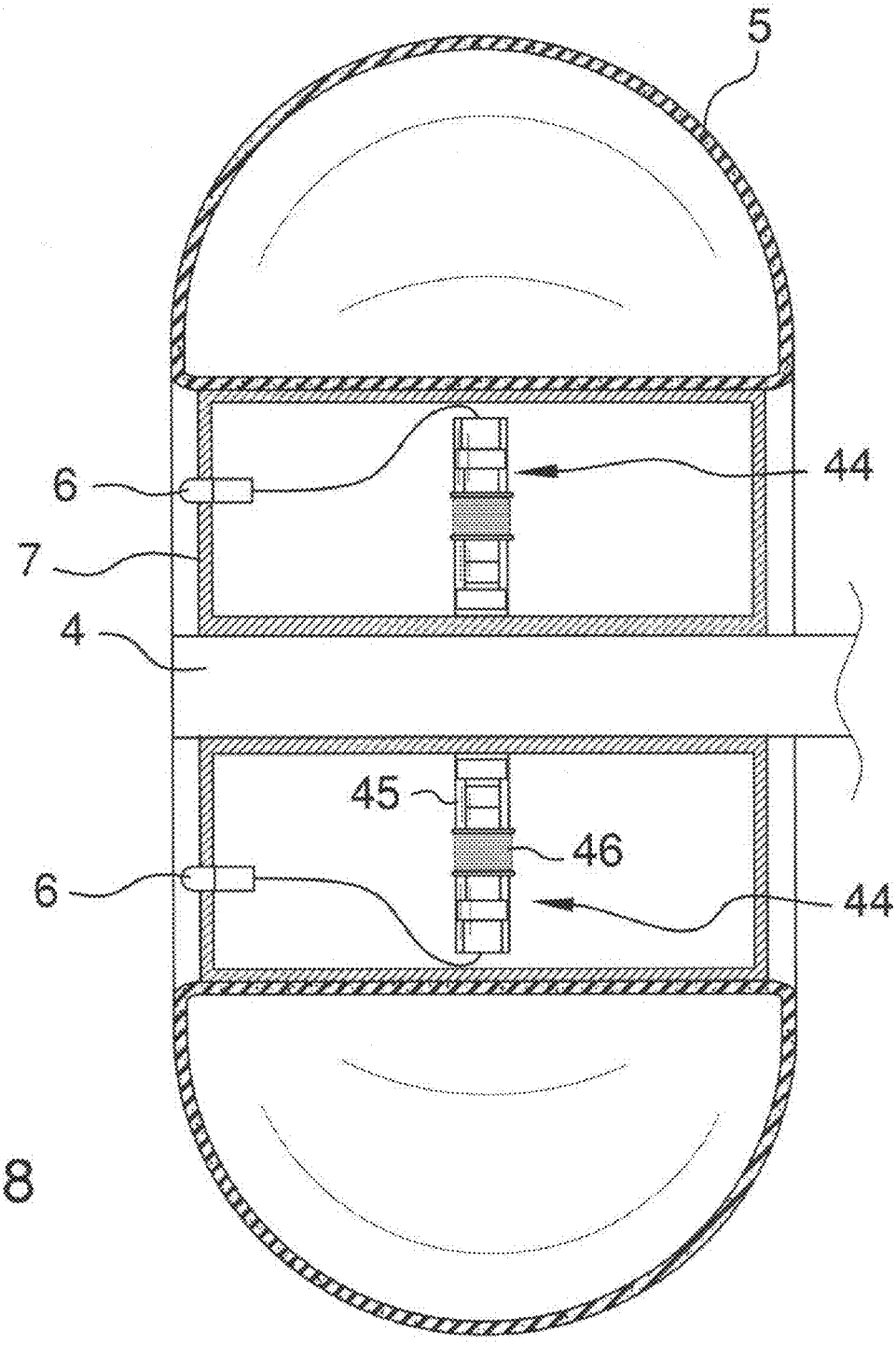
FIG. 8 is a sectional view, taken along section lines 8-8 in FIG. 1, of a wheel of an illustrative embodiment of the lighted cooler.

As illustrated in FIG. 5, an axle 4 extends transversely across the cooler body 2. Wheels 5 are mounted on respective ends of the axle 4. As shown in FIG. 8, each wheel 5 may include a wheel hub 7 which is mounted on the axle 4 according to the knowledge of those skilled in the art. Multiple wheel lights 6, each of which may be an LED, for example, are provided on the exterior surface of the wheel hub 7. Faraday energy sources 44, each having a magnet 45 and a coil 46, may be provided in the wheel hub and electrically connected to the wheel lights 6 to provide power to illuminate the wheel lights 6. Alternative energy sources such as batteries, for example, may be connected to the wheel lights 6. As shown in FIG. 6, in some embodiments of the lighted cooler 1*a*, the axle 4 (FIG. 5) drivingly engages one or multiple tank-style wheels 32 on each side of the cooler body 2. A continuous track 33 is trained around and driven by the tank-style wheels 32 responsive to operation of the drive motor 8.

As shown in FIGS. 4 and 5, a motor compartment 13 may be provided in the cooler body 2. A drive motor 8 is provided in the motor compartment 13 and drivingly engages the axle 4 such as through drive gears 9. A power source such as batteries 10, for example, is electrically connected to the drive motor 8 such as through motor wiring 12, for example. A directional control pad 16 for the drive motor 8 may be provided on the handle grip 15 or in any other suitable location and connected to the drive motor 8 to facilitate forward or reverse operation of the axle 4 and wheels 5. A retractable recharge cord 11 may be connected to the batteries 10 or other power source and extend through a cord opening (not shown) provided in the cooler body 2 for connection to an electrical outlet (not shown) for recharging of the batteries 10.

As shown in FIGS. 4 and 5, a light compartment 24 is provided at a front end of the cooler body 2. A convex front body panel 25 extends from the cooler body 2 and closes the light compartment 24. A transparent convex light panel 28 extends from the cooler body 2 over the front body panel 25.

Multiple cooler lights 26, which may be LEDs, are supported by the front body panel 25 and are positioned adjacent to the light panel 28. As shown in FIG. 4, the cooler lights 26 are electrically connected to the batteries 10 or other power source such as through light wiring 27, for example. A light control button 18 may be provided on the handle grip 15 or other suitable location and electrically connected between the batteries 10 and the cooler lights 26 to facilitate selective turning of the cooler lights 26 on and off. The light control button 18 may additionally be electrically connected to the wheel lights 6 provided on the wheel hub 7 of each wheel 5. Alternatively, a separate light control button (not shown) may be provided on the handle grip 15 or in an alternative location and electrically connected to the wheel lights 6 for separate control of the wheel lights 6.

In typical use of the lighted cooler 1, the retractable outer lid 20 and the retractable inner lid 21 are opened as shown in FIGS. 1A and 3 to facilitate placement of cooled foods and/or beverages (not shown) in the cooler interior 3. The foods and/or beverages may be secured in the nets 30 provided in the cooler interior 3. The retractable inner lid 21 and the retractable outer lid 20 are then closed, as shown in FIGS. 1, 2 and 4. A user (not shown) grips the handle grip 15 on the handle shaft 14 and manipulates the directional control pad 16 to operate the drive motor 8 (FIGS. 4 and 5) in the forward or reverse direction. This facilitates travel of the lighted cooler 1 in the forward or reverse direction, respectively, as the wheels 5 rotate on a supporting surface (not shown). Alternatively, the lighted cooler 1 can be pushed or pulled on the supporting surface by pushing or pulling, respectively, the handle shaft 14 at the handle grip 15. The cooler lights 26 can be selectively illuminated by depression of the light control supporting button 18. In some embodiments, the retractable recharge cord 11 can be selectively extended from the cooler body 2 and plugged into an electrical outlet (not shown) to recharge the batteries 10.

Figure 7:
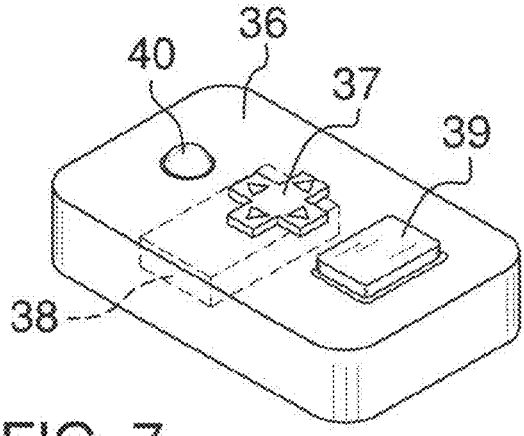
FIG. 7 is a perspective view of a remote control unit of an illustrative embodiment of the lighted cooler.

Referring next to FIG. 7, in some embodiments the drive motor 8 (FIG. 5) may be operated using a hand-held remote control unit 36. The remote control unit 36 may include a directional control pad 37 to facilitate directional control of the drive motor 8. A transmitter 38 is connected to the directional control pad 37. A power button 39 may be provided on the remote control unit 36 for turning of the drive motor 8 on and off. An LED 40 may be provided on the remote control unit 36 to indicate the "on" status of the remote control unit 36. A receiver (not shown) is connected to the drive motor B and receives transmission signals (not shown) from the remote control unit 36. The receiver translates the transmission signals into operation of the drive motor 8 in the forward or reverse direction.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A lighted cooler, comprising:

a thermally-insulated cooler body having a cooler body interior;

at least one lid carried by said cooler body and closeable over said cooler body interior;

a front body panel carried by said cooler body;

a transparent light panel carried by said cooler body in spaced-apart relationship with respect to said front body panel;

a plurality of lights carried by said front body panel adjacent to said transparent light panel;

a power source electrically connected to said plurality of lights; and a light control button electrically connected between said power source and said plurality of lights.

2. The lighted cooler of claim 1 further comprising a pair of wheels carried by said cooler body.

3. The lighted cooler of claim 2 further comprising a drive motor drivingly engaging said pair of wheels.

4. The lighted cooler of claim 3 further comprising a directional control pad connected to said drive motor.

5. The lighted cooler of claim 1 further comprising a handle shaft extending from said cooler body and a handle grip provided on said handle shaft.

6. The lighted cooler of claim 1 wherein said cooler body has a generally elongated, elliptical, egg-shaped configuration.

7. The lighted cooler of claim 1 further comprising two sets of track-style wheels carried by said cooler body and a pair of tracks engaged by said sets of track-style wheels, respectively.

8. The lighted cooler of claim 1 wherein said power source comprises a pair of batteries.

9. The lighted cooler of claim 8 further comprising a retractable recharge cord electrically connected to said pair of batteries and extending from said cooler body.

10. A lighted cooler, comprising:

a pair of wheels;

a generally elongated, elliptical, egg-shaped, thermally-insulated cooler body carried by said pair of wheels and having a cooler body interior;

a retractable inner lid carried by said cooler body and closeable over said cooler body interior;

a retractable outer lid carried by said cooler body and closeable over said inner lid;

a handle shaft extending from said cooler body;

a handle grip provided on said handle shaft;

a drive motor drivingly engaging said pair of wheels;

a generally convex front body panel carried by said cooler body;

a generally convex, transparent light panel carried by said cooler body in spaced-apart relationship with respect to said front body panel;

a plurality of lights carried by said front body panel adjacent to said transparent light panel;

a power source electrically connected to said plurality of lights;

a light control button electrically connected between said power source and said plurality of lights and provided on said handle grip; and a directional control pad provided on said handle grip and electrically connected between said power source and said drive motor.

11. The lighted cooler of claim 10 wherein said power source comprises a pair of batteries.

12. The lighted cooler of claim 11 further comprising a retractable recharge cord electrically connected to said pair of batteries and extending from said cooler body.

* * * * *